US006286473B1

(12) United States Patent
Zaremba

(10) Patent No.: US 6,286,473 B1
(45) Date of Patent: Sep. 11, 2001

(54) SYSTEM FOR DAMPING ENGINE SPEED OSCILLATIONS

(75) Inventor: Alexander Timofeevich Zaremba, Dearborn Heights, MI (US)

(73) Assignee: Ford Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/540,323

(22) Filed: Mar. 31, 2000

(51) Int. Cl.[7] ..... F02B 75/06
(52) U.S. Cl. ..... 123/192.1
(58) Field of Search ..... 123/192.1

(56) References Cited

U.S. PATENT DOCUMENTS 4,699,097 10/1987 Tanaka et al. .
4,862,009 8/1989 King .
4,922,869 5/1990 Kadomukai et al. .
5,033,425 7/1991 Kadomukai et al. .
6,085,723 * 7/2000 Pels et al. ..... 123/192.1

FOREIGN PATENT DOCUMENTS 11-325 168 * 11/1999 (JP) .

* cited by examiner

*Primary Examiner*—Noah P. Kamen
(74) *Attorney, Agent, or Firm*—Ford Global Tech.

(57) ABSTRACT

A control strategy for use in combination with a hybrid electric vehicle 10 including a propulsion system 12 having an engine 14 and a starter/alternator 16 which is operatively coupled to crankshaft 18 of engine 14. The control strategy utilizes the starter/alternator 16 as an "active" flywheel and implements a variable parameter notch filter and a lead compensator to attenuate crankshaft speed oscillations.

18 Claims, 4 Drawing Sheets

SYSTEM FOR DAMPING ENGINE SPEED OSCILLATIONS

FIELD OF THE INVENTION

This invention relates to a system for damping engine speed oscillations and more particularly, to a system which utilizes a starter/alternator to damp crankshaft speed oscillations within a hybrid electric vehicle, thereby providing improved idle quality and fuel economy.

BACKGROUND OF THE INTENTION

The periodic fuel combustion processes within an internal combustion engine and the generally nonlinear engine geometry result in torque disturbances and crankshaft speed oscillations. These crankshaft speed oscillations adversely effect the smoothness and quality of the vehicle's ride, cause increased noise, vibration and harshness ("NVH"), and undesirably reduce fuel economy. Typically, a conventional "passive" flywheel is coupled to the end of the crankshaft to reduce the pulsation of the crankshaft speed.

Conventional flywheels are relatively massive and undesirably increase the overall weight and packing space of the vehicle's engine, and undesirably reduce fuel economy. Additionally, the effectiveness of flywheels in damping crankshaft speed oscillations is severely limited since conventional flywheels are "passive", devices and are incapable of adjusting to changing operating conditions and circumstances.

There is therefore a need for a system for damping crankshaft speed oscillations which overcomes the drawbacks of prior systems and methods and which utilizes an active supplemental torque source such as a starter-alternator to attenuate crankshaft speed oscillations.

SUMMARY OF THE INVENTION

It is a first object of the invention to provide a system for damping engine crankshaft speed oscillations which overcomes the previously delineated drawbacks of prior methods, apparatuses, and devices.

It is a second object of the invention to provide a system which utilizes a supplemental torque source to damp engine crankshaft speed oscillations.

It is a third object of the invention to provide a system which is adapted for use within a hybrid electric vehicle and which utilizes a starter/alternator to actively damp engine crankshaft speed oscillations.

It is a fourth object of the invention to provide a system for damping engine crankshaft oscillations which includes a variable inverse notch filter and a variable lead compensator to attenuate crankshaft speed oscillations at a desired disturbance frequency.

According to a first aspect of the present invention, a system is provided for use in combination with a vehicle including an engine which drives a crankshaft at a first speed. The system is effective to damp oscillations in the first speed and includes an electric machine which is operatively coupled to the crankshaft and which is effective to selectively provide torque to the crankshaft, effective to alter the first speed; a sensor which measures the first speed and which generates a first signal based upon the measured first speed; and a controller which is communicatively coupled to the electric machine and to the sensor. The controller is effective to receive the first signal and, based upon the first signal, to communicate a second signal to the electric machine, the second signal being effective to cause the electric machine to selectively provide torque to the crankshaft, effective to alter the first speed in a manner which substantially attenuates the oscillations.

According to a second aspect of the present invention, a method is provided for damping speed oscillations in an engine having a crankshaft which rotates at a first speed, said method comprising the steps of providing a supplemental torque source; mounting said supplemental torque source on said crankshaft; measuring said first speed; generating a first signal corresponding to said measured first speed; processing said first signal by use of a variable parameter notch filter, effective to generate a second signal; utilizing said second signal to generate an output signal; and communicating said output signal to said supplemental torque source effective to cause said supplemental torque source to selectively provide torque to said crankshaft, said torque being effective to alter said first speed, thereby substantially attenuating said speed oscillations.

Further objects, features, and advantages of the invention will become apparent from the following detailed description of the preferred embodiment of the invention and by reference to the following drawings.

DETAILED DESCRIPTION OF THE PREFERRED EMBODIMENT OF THE INVENTION

Figure 1:
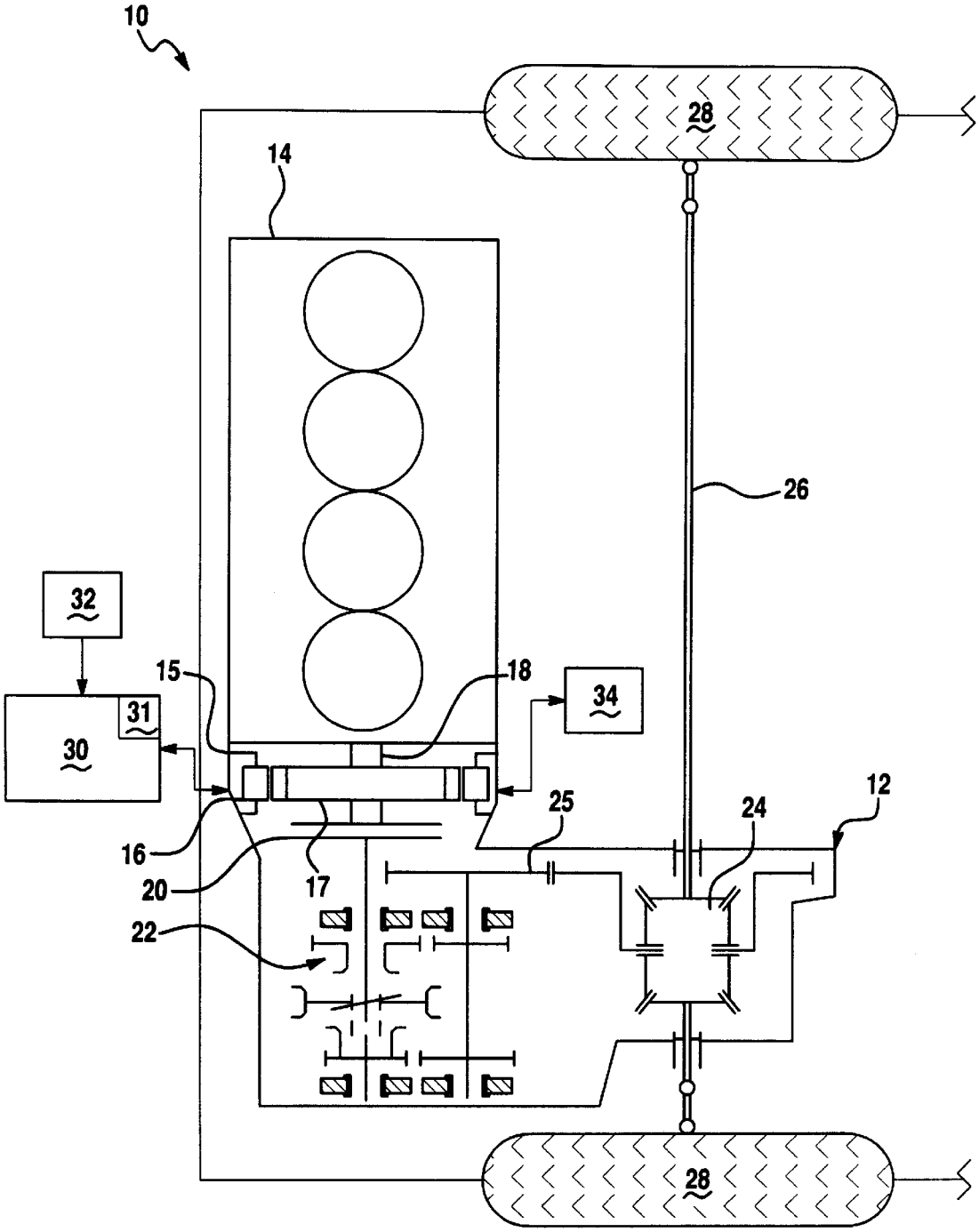
FIG. 1 is a schematic diagram of a vehicle drive system having a control system for damping crankshaft oscillations which is made in accordance with the teachings of a preferred embodiment of the present invention.

Referring now to FIG. 1, there is shown a vehicle having a propulsion or drive system 12 which utilizes a control strategy or system for damping crankshaft oscillations in accordance with the teachings of the preferred embodiment of the present invention. Drive system 12 includes an internal combustion engine 14, an electric machine, motor/generator or starter/alternator 16 which is operatively coupled to a conventional charge storage device 34 (e.g., a battery), and a controller or control unit 30, which is communicatively coupled to starter/alternator 16 and to conventional vehicle operating sensors 32. As should be appreciated by one of ordinary skill in the art, drive system 12 is a serial type propulsion system for use in a hybrid electric vehicle. It should further be appreciated that in alternate embodiments, propulsion system 12 may be arranged in other configurations such as a conventional parallel type hybrid configuration.

Drive system 12 further includes a conventional transmission assembly 22 which is selectively coupled to crankshaft 18 by use of a conventional clutch assembly 20. Transmission assembly 22 is operatively coupled to and provides torque and power to a front differential assembly 24 by use of output shaft 25. Transmission assembly 22 transfers torque and power through the differential assembly 24 to the front axle 26, thereby drivably turning the front wheels 28 of vehicle 10.

As described more fully and completely below, controller 30 receives signals from sensors 32, and based upon the received signals, controller 30 utilizes starter/alternator 16 as a supplemental torque source to act as an active "flywheel", thereby damping crankshaft speed oscillations. By utilizing starter/alternator 16 as an "active" flywheel, drive system 12 reduces the overall weight of vehicle 10 (e.g., by eliminating a conventional flywheel), improves drive line NVH, idle quality and fuel economy.

In the preferred embodiment of the invention, engine 14 is a conventional internal combustion engine which drivably rotates and delivers torque through crankshaft 18. Electric machine 16 is a conventional motor/generator or starter/alternator unit of the type which is adapted for use in a hybrid electric vehicle. Starter/alternator 16 includes a stator assembly 15 and a rotor assembly 17 which is operatively coupled or mounted to crankshaft 18 in a known and conventional manner. By use of the control strategy of the preferred embodiment, starter/alternator 16 selectively provides torque to the crankshaft 18, effective to remove or damp crankshaft oscillations. It should be appreciated that starter/alternator 16 may also function as a generator to convert drive train energy into electrical energy which is used to charge battery 34 and to electrically power various electrical components of vehicle 10, and as a motor to supplement the torque provided by engine 14. Electrical charge storage device 34 supplies power to motor-generator 16 and can further be used to recover and store energy during vehicle braking.

Controller 30 includes one or more microprocessors and/or integrated circuits which cooperatively perform the below-described calculations, algorithms, and/or control strategies. In the preferred embodiment of the invention, controller 30 includes a conventional memory unit 31 having both permanent and temporary memory. Memory 31 is adapted to and does store at least a portion of the operating software which directs the operation of controller 30. As should also be apparent to those of ordinary skill in the art, controller 30 and memory 31 may actually comprise a plurality of commercially available, conventional, and disparate chips or devices, which are operatively and communicatively linked in a cooperative manner.

Sensors 32 comprise one or more conventional and commercially available sensors which measure information pertaining to the engine. In the preferred embodiment of the invention, sensors 32 include one or more conventional engine or crankshaft speed sensors and one or more crankshaft position sensors. Sensors 32 provide data, such as engine speed and position values to controller 30, which utilizes these values, as discussed more fully and completely below, to generate torque commands to starter/alternator 16 which substantially reduce or eliminate the undesirable speed oscillations of crankshaft 18. It should be appreciated that sensors 32 may include conventional filtering and/or processing devices or circuits (e.g., low pass, high pass, and/or band pass filters) which filter and/or process the measured or sensed data prior to sending the data to controller 30.

Figure 2:
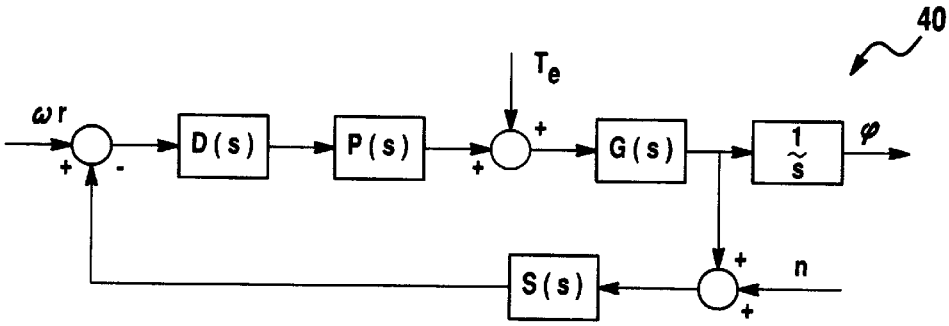
FIG. 2 is a block diagram illustrating a control system model of the vehicle drive system shown in FIG. 1.

Referring now to FIG. 2, there is shown a block diagram 40 which models or represents the present control system or "active" flywheel function of the present invention. Particularly, in diagram 40, "D(s)" represents the dynamics of controller 30, "P(s)" represents the dynamics of the electric component of starter/alternator 16, "G(s)" represents the mechanical component of starter/alternator 16, and "S(s)" represents the engine speed sensor or sensor 32. Furthermore, in diagram 40, "$\omega_r$" represents the reference crankshaft speed, "n" represents sensor "noise", and "$\phi$" represents the crank angle (e.g., the angular position of crankshaft 18). The torque provided by engine 14 "$T_e$" is considered an external disturbance, and controller 30 utilizes the starter/alternator 16 as an "active flywheel" to attenuate "ac" components (e.g., disturbances) of the engine torque, thereby substantially eliminating crankshaft speed oscillations. In one non-limiting embodiment, the electric component P(s) is modeled by the system function or equation $$P(s) = \frac{1}{T_a s + 1}$$

where $T_a$ is an electrical time constant; the mechanical component G(s) is modeled by the system function or equation $$G(s) = \frac{1}{Js + b}$$

where J is the moment of inertia of drive system 12 and b is a damping coefficient greater than zero; and the engine speed sensor is modeled as a first order low pass filter by the system function or equation $$S(s) = \frac{2\pi p_s}{s + 2\pi p_s}$$

where $p_s$ is the bandwidth of the speed sensor. The dynamics of controller 30 (i.e., D(s)) are discussed more fully and completely below.

In the preferred embodiment, controller 30 is partitioned into an "inner" loop or portion and "outer" loop or portion. The inner loop is run or operated at a relatively high frequency (e.g., 10 kHz), and includes the field oriented control of starter/alternator 14. The outer loop is run or operated at a slower frequency (e.g., 1 kHz), and provides torque commands for the inner loop to attenuate "ac" components of the engine torque.

Figure 3:
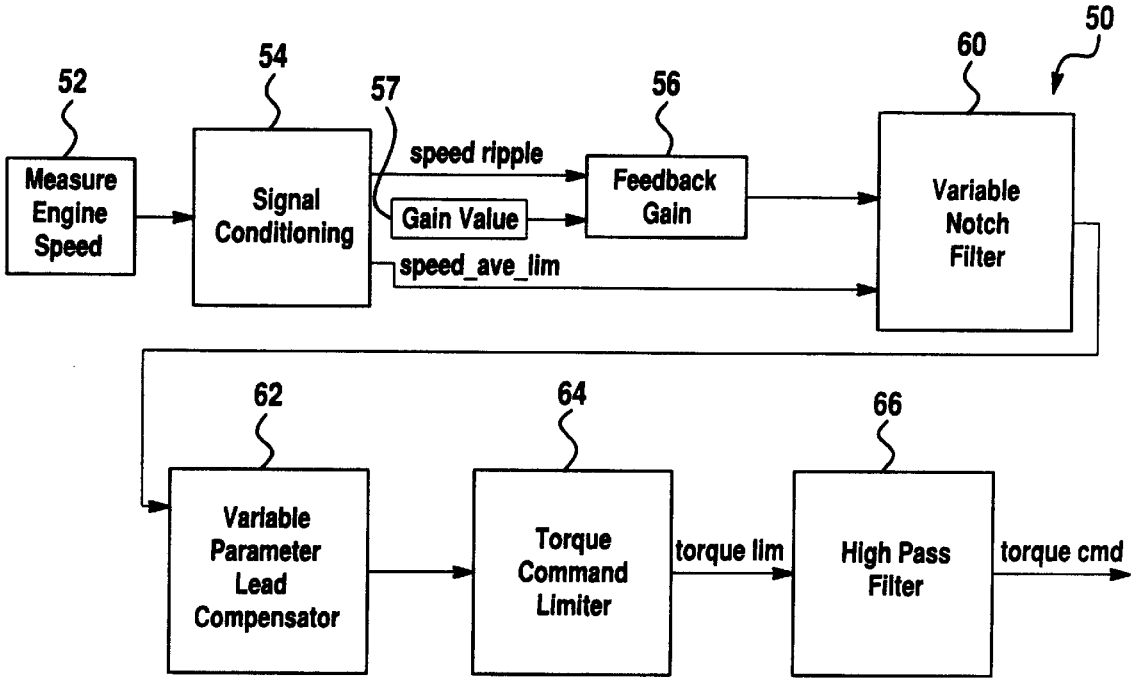
FIG. 3 is a block diagram illustrating the control strategy for damping crankshaft oscillations which is performed by the control system used within the vehicle drive system of FIG. 1.

Referring now to FIG. 3, there is shown one non-limiting embodiment of the control strategy or system 50 (e.g., an outer loop control strategy) which is utilized or executed by controller 30 to damp crankshaft speed oscillations. Control strategy 50 begins at functional block or step 52, where the engine or crankshaft speed in revolutions per minute ("RPM") is measured by use of sensors 32. The measured engine speed is entered or inputted into signal conditioning functional block or step 54, which partitions the signal into a dc component (e.g., average speed) and an ac component (e.g., speed ripple). The signal conditioning process or operation performed within step 54 is illustrated by flow diagram 70 of FIG. 4.

Figure 4:
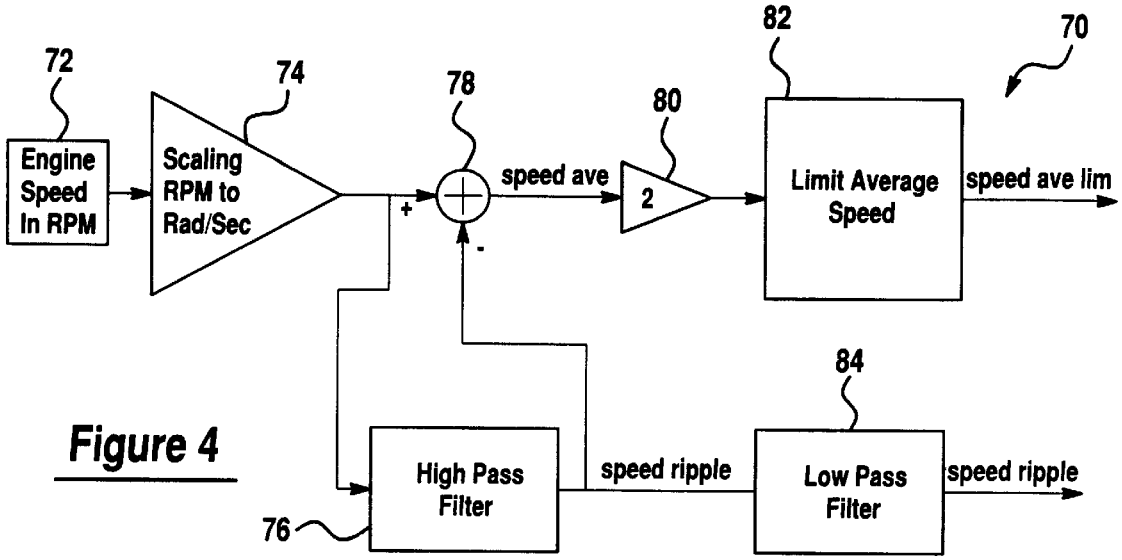
FIG. 4 is a block diagram illustrating a portion of the control strategy for damping crankshaft oscillations which is shown in FIG. 3.

Referring now to FIG. 4, the measured engine speed in RPM, illustrated by block 72, is communicated to functional block or step 74, which represents a conventional scaling circuit or process and is effective to convert the measured engine speed in RPM into radians per second ("rad/sec"). The scaled engine speed is communicated to functional blocks 76 and 78. In functional block or step 76, the scaled engine speed is exposed to a conventional high pass filtering process or circuit, effective to remove the "dc" component of the engine speed, thereby extracting the "ac" component or the "speed ripple" (e.g., crankshaft speed oscillations) present within the engine speed.

The extracted speed ripple is communicated to functional blocks or steps 78 and 84. In functional block or step 84, the extracted speed ripple signal is exposed to a low pass filter to remove noise. The filtered signal is outputted from block 84 as a speed ripple output signal ("speed ripple"). In functional block or step 78, the extracted speed ripple is subtracted from the scaled engine speed to yield an average engine speed value. In functional block or step 80, the average speed is scaled by a factor of two, thereby adjusting the speed to compensate for two firing events per crankshaft revolution which occur within engine 14. In functional block or step 82, the scaled average speed is limited by use of a conventional limiting circuit or process, thereby eliminating transients and providing a limited average speed output signal ("speed_ave_lim").

Referring again to FIG. 3, the limited average speed output is communicated directly to functional block or step 60. The speed ripple signal is communicated to functional block or step 56, which represents a feedback gain having a predetermined and/or selectable value 57. The resulting amplified speed ripple signal is communicated to functional block or step 60.

Functional block or step 60 represents a highly tuned variable parameter or "inverse" notch filter which is utilized by controller 30 to attenuate engine speed pulsation or oscillations at a given frequency. In one non-limiting embodiment, the inverse notch filter is represented by the following system function or equation:

$$D(s) = \frac{s^2 + 2\xi_d\omega_n + \omega_n^2}{s^2 + 2\xi_n\omega_n s + \omega_n^2} \quad \text{Eq. (1)}$$

where $\xi_d$=0.5 $\xi_n$ is preferably relatively small (e.g., $\xi_n$=0.05), and $\omega_n$ is selected close to the disturbance frequency $\omega_d$ (e.g., the oscillation frequency). In one non-limiting embodiment of the invention, the variable parameter notch filter 60 (represented by Eq. (1)) may be implemented by use of a "zero-order hold" ("ZOH") approximation. Particularly, the ZOH approximation is performed in the following manner by use of the following calculations:

coefficients $a_1$ and $a_2$ are calculated as follows:

$$a_1=2\xi_n\omega_n \quad \text{Eq. (3)}$$

$$a_2=\omega_n \quad \text{Eq. (4)}$$

where $\omega_n$ is set equal to the average engine speed and $\xi_n$ is the selected damping ratio. Coefficients $\lambda_0$ and $\lambda_1$ are calculated as follows:

$$\lambda_0 = -\frac{a_1 T}{2}, \quad \text{Eq. (5)}$$

-continued $$\lambda_1 = T\sqrt{a_2 - \frac{a_1^2}{4}} \quad \text{Eq. (6)}$$

where T is the relevant time period. Coefficients $\lambda_0$ and $\lambda_1$ are then used to calculate $\alpha_0$ and $\alpha_1$ as follows:

$$\alpha_0 = e^{\lambda_0}\left(\cos\lambda_1 - \sin\lambda_1 \frac{\lambda_0}{\lambda_1}\right), \quad \text{Eq. (7)}$$

$$\alpha_1 = e^{\lambda_0}\frac{\sin\lambda_1}{\lambda_1}. \quad \text{Eq. (8)}$$

Variables $\alpha_0$ and $\alpha_1$ are used to determine matrixes F, G:

$$F = \begin{pmatrix} \alpha_0 - \alpha_1 a_1 T & -\alpha_1 a_2 T \\ \alpha_1 T & \alpha_0 \end{pmatrix} \quad \text{Eq. (9)}$$

$$G = \begin{pmatrix} \alpha_1 T \\ -\frac{1}{a_2}(\alpha_0 - \alpha_1 a_1 T - 1) - \frac{a_1}{a_2}\alpha_1 T \end{pmatrix}. \quad \text{Eq. (10)}$$

Finally, the matrixes F and G are used in the following equations as a discrete model for the variable notch filter:

$$x(k+1)=Fx(k)+Gu(k) \quad \text{Eq. (11)}$$

$$y\ k+1)=Hx(k)+Ju(k) \quad \text{Eq. (12)}$$

where x(k) represents the state vector, y(k) represents the response or output signal, u(k) represents the input signal, J is equal to one, and H is the vector ($b_1$–$a_1$, 0) where $b_1=2\xi_d\omega_n$.

Although the foregoing ZOH approximation yields very accurate results, it requires a relatively large amount of computation time and may not be the best approximation in applications where computation time is critical. Thus, in the preferred embodiment of the invention, a different design technique is implemented which utilizes a "Tustin" approximation. Particularly, the "Tustin" approximation is used within functional block or step 60.

The Tustin method uses approximation $$s = \frac{2}{T}\frac{1 - z^{-1}}{1 + z^{-1}}$$

for space vector derivatives, and after some manipulations the discrete time variable notch filter Tustin approximation is as follows:

$$x_{1k+1} = \frac{1 - a_1\frac{T}{2} - a_2\frac{T^2}{4}}{1 + a_1\frac{T}{2} + a_2\frac{T^2}{4}}x_{1k} - \frac{a_2 T}{1 + a_1\frac{T}{2} + a_2\frac{T^2}{4}}x_{2k} + \frac{T}{2\left(1 + a_1\frac{T}{2} + a_2\frac{T^2}{4}\right)}(u_k + u_{k+1}); \quad \text{Eq. (12)}$$

-continued $$x_{2k+1} = x_{2k} + \frac{T}{2}\left[\frac{2x_{1k}}{1 + a_1\frac{T}{2} + a_2\frac{T^2}{4}} - \frac{a_2 T}{1 + a_1\frac{T}{2} + a_2\frac{T^2}{4}}x_{2k} + \frac{T}{2\left(1 + a_1\frac{T}{2} + a_2\frac{T^2}{4}\right)}(u_k + u_{k+1})\right]; \quad \text{Eq. (13)}$$

and $$y_{k+1}=C_1x_{1k+1}+u_{k+1} \quad \text{Eq. (14);}$$

where the coefficients $a_1$ and $a_2$ are respectively calculated by use of Eq. (3) and Eq. (4), $x_k$ represents a state vector ($x_{1k}$, $x_{2k}$), $y_k$ represents the output or system response, $u_k$ represents the system input, and $C_1$ represents the vector ($b_1-a_1$, 0) where $b_1=2\xi_d\omega_n$.

The output of notch filter 60 is communicated to functional block or step 62 which represents a high frequency variable parameter lead compensator. In the preferred embodiment of the invention, variable lead compensator 62 may be modeled by use of the following equation:

$$D(s) = \frac{b}{a}\frac{s+a}{s+b},\ \frac{b}{a} = \alpha\rangle 1 \quad \text{Eq. (15)}$$

where $\alpha>1$ is a lead ratio. The high frequency lead compensator 62 improves the phase margin response of the system, thereby improving system stability.

Figure 5:
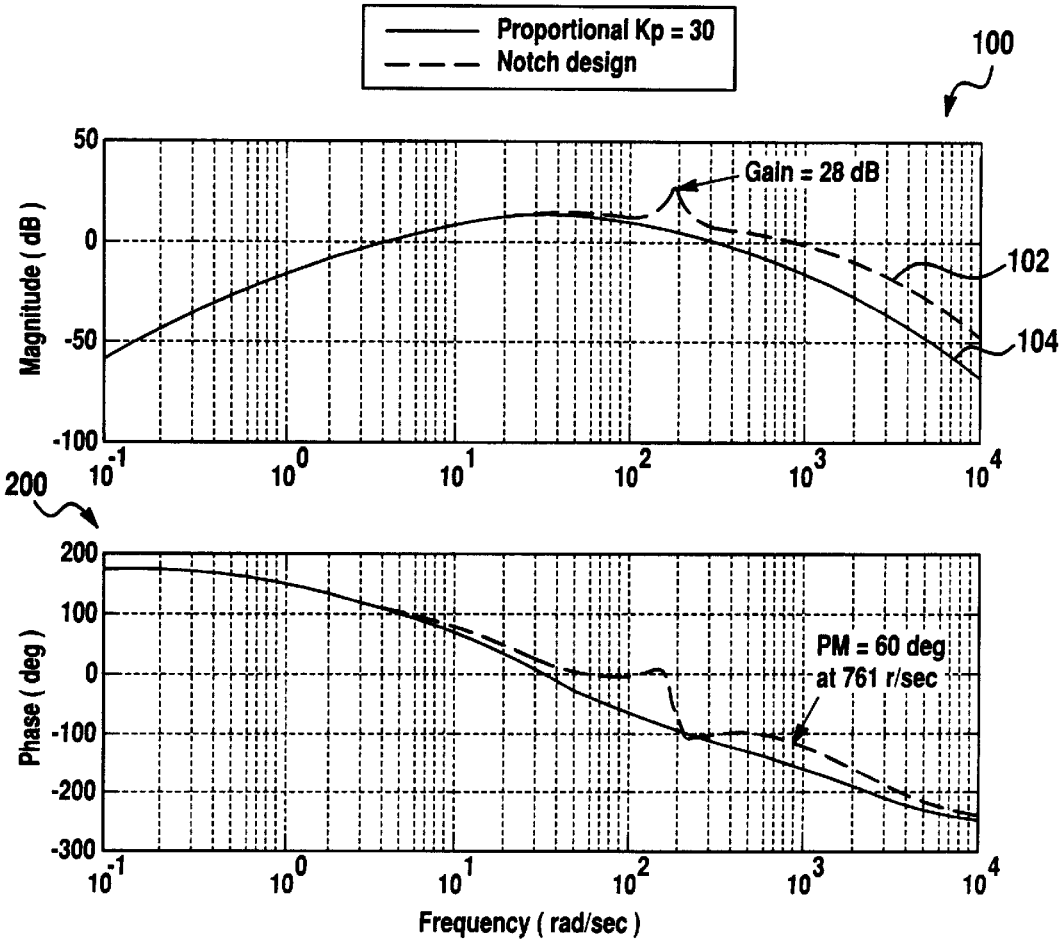
FIG. 5 is two graphs which illustrate the frequency response characteristics of the inverse notch filter used within the strategy shown in FIG. 3.

The resulting output signal is highly tuned to the given disturbance frequency. One example of the frequency response characteristics of the inverse notch filter 60 and lead compensator 62 utilized within the present system is illustrated in graphs 100 and 200 of FIG. 5. Particularly, in graph 100, response curve 102 represents the characteristic of an inverse notch filter in which $\xi_d$=0.5, $\xi_n$ is set to a relatively small value (e.g., $\xi_n$=0.05), and $\omega_n$=180 rad/sec, compared to the response curve 104 of a conventional proportional controller or control system utilizing a proportional gain Kp of 30. As shown in graph 100, the response 102 of the inverse notch filter has a sharp gain increase of approximately 28 dB at a frequency $\omega$ of 180 rad/sec, thereby allowing controller 30 to attenuate the disturbance around frequency $\omega_n$. As shown in graph 100, the added gain at the desired frequency $\omega_n$ provides significant improvement over the proportional control response 104. Furthermore, as illustrated in graph 200 of FIG. 5, the phase margin of PM=60 degrees is achieved by compensator 62 at a lower frequency (e.g., 761 rad/sec) than in the case of a pure lead compensator.

The resulting output signal from block 62 comprises a torque control or command signal or value which is communicated to functional block or step 64. Functional block or step 64 is a conventional limiter or limiting circuit, process or function, which limits the possible torque control signal to a certain predetermined range, thereby substantially eliminating any undesirably high or low torque command values which could damage the system or cause instability. The limited torque control signal is communicated to functional block or step 66 which utilizes a high pass filter to remove the dc component of the torque control signal. The torque control signal which is output from block 66 is communicated by controller 30 to starter/alternator 16 and is effective to cause starter alternator to compensate for to attenuate the undesirable crankshaft oscillations.

The "active" flywheel strategy of the present system provides superior damping of crankshaft oscillations over prior systems, devices and methods. For example and without limitation, the present system significantly reduces crankshaft speed oscillations by increasing the gain at the disturbance frequency by use of variable parameter notch filter, and further improves the overall system phase margin with the use of lead compensator 62.

Figure 6:
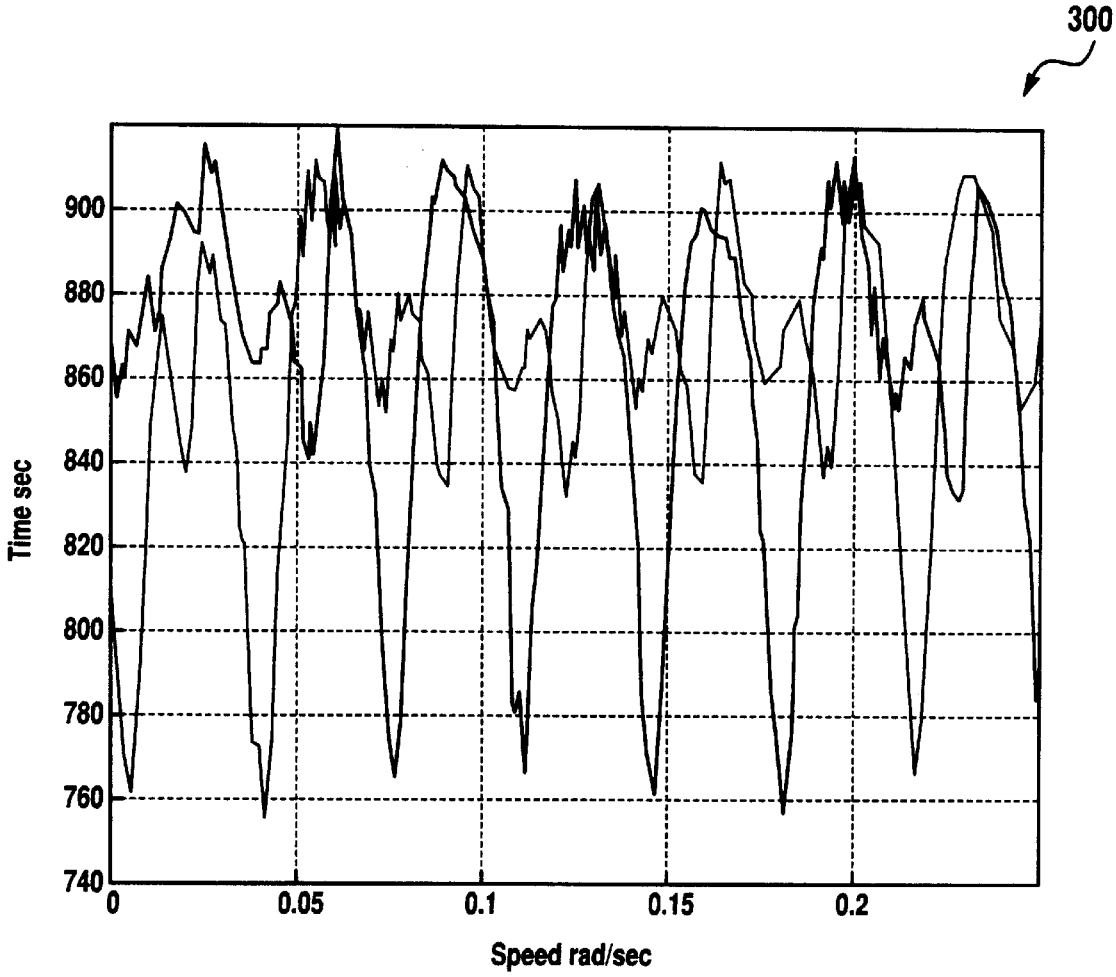
FIG. 6 is a graph which illustrates the reduction in the value of the crankshaft speed pulsation provided by one non-limiting embodiment of the present invention.

Experimental data of the notch filter of the present invention implemented upon a drive system such as system 12 has shown drastic improvement of engine pulsation attenuation even when using conventional drive system hardware which is not optimized specifically for active flywheel function. For example and without limitation, graph 300 of FIG. 6 represents experimental data of the afore-described control system implemented on a conventional serial hybrid vehicle and illustrates that the root-mean-square ("r.m.s.") value of the speed pulsation is reduced essentially.

It is understood that the invention is not limited by the exact construction or method illustrated and described above, but that various changes and/or modifications may be made without departing from the spirit and/or the scope of the inventions.

What is claimed is:

1. A system for use in combination with a vehicle including an engine which drives a crankshaft at a first speed, said system being effective to damp oscillations of said first speed and comprising:

an electric machine which is operatively mounted to said crankshaft and which is effective to selectively provide torque to said crankshaft, thereby altering said first speed;

a sensor which measures said first speed and which generates a first signal based upon said measured first speed; and a controller which is communicatively coupled to said electric machine and to said sensor, said controller being effective to receive said first signal, to partition this signal into an ac component and a dc component, to process this partitioned signal by use of an inverse notch filter and, based upon said processed signal, to communicate a second signal to said electric machine, said second signal being effective to cause said electric machine to selectively provide torque to said crankshaft, effective to alter said first speed in a manner which substantially attenuates said oscillations.

2. The system of claim 1 wherein said electric machine is a starter/alternator.

3. The system of claim 1 wherein said controller is further effective to process said first signal by use of an inverse notch filter, and is effective to attenuate said crankshaft oscillations at a certain frequency value determined by said inverse notch filter.

4. The system of claim 1 wherein said controller is further effective to implement said inverse notch filter by use of a zero-order hold approximation.

5. The system of claim 1 wherein said controller is further effective to implement said inverse notch filter by use of a Tustin approximation.

6. The system of claim 1 wherein said system has a phase margin and wherein said controller is further effective to process said first signal by use of a lead compensator, effective to improve said phase margin.

7. The system of claim 3 wherein said controller is further effective to partition said first signal into a dc component and an ac component prior to using said inverse notch filter.

8. The system of claim 1 wherein said controller is further effective to limit said second signal to a predetermined range of values.

9. The system of claim 1 wherein said vehicle is a hybrid electric vehicle.

10. A hybrid electric vehicle having improved damping of engine crankshaft speed oscillations and comprising:

an engine which drivably rotates a crankshaft at a first speed which includes certain oscillations;

a starter/alternator which is operatively coupled to said crankshaft, and which is effective to selectively provide torque to said crankshaft;

a sensor which measures said first speed and which generates a first signal based upon said measured first speed; and a controller which is communicatively coupled to said sensor and to said starter/alternator, said controller being effective to receive said first signal, to partition said first signal into a second signal and a third signal, to filter said second signal and said third signal by use of an inverse notch filter, and to communicate a torque command signal to said starter/alternator based upon said filtered second and third signals, said torque command signal being effective to cause said starter/alternator to selectively provide torque to said crankshaft, thereby substantially damping said certain oscillations in said first speed.

11. The hybrid electric vehicle of claim 10 wherein said controller has a certain phase margin and wherein said controller is further effective to process said torque command signal by use of a lead compensator, thereby improving said phase margin.

12. The hybrid electric vehicle of claim 10 wherein said controller is further effective to process said torque command signal by use of a limiting function.

13. The hybrid electric vehicle of claim 10 wherein said torque command signal includes an ac component and a dc component, and wherein said controller is further effective to process said torque command signal by use of a high pass filter, thereby removing said dc component prior to communicating said torque command signal to said starter/alternator.

14. A method for damping speed oscillations in an engine having a crankshaft which rotates at a certain speed, said method comprising the steps of:

providing a supplemental torque source;

mounting said supplemental torque source on said crankshaft;

measuring said first speed;

generating a first signal corresponding to said measured first speed;

processing said first signal by use of inverse notch filter, effective to generate a second signal;

utilizing said second signal to generate an output signal; and communicating said output signal to said supplemental torque source effective to cause said supplemental torque source to selectively provide torque to said crankshaft, said torque being effective to alter said first speed, thereby substantially attenuating said speed oscillations.

15. The method of claim 14 wherein said supplemental torque source comprises a starter/alternator.

16. The method or claim 14 further comprising the steps of:

processing said second signal by use of a variable lead compensator, effective to generate a third signal; and utilizing said third signal to generate said output signal.

17. The method of claim 16 further comprising the steps of:

processing said third signal by use of a limiting circuit, effective to generate a fourth signal; and utilizing said fourth signal to generate said output signal.

18. The method of claim 17 wherein said fourth signal includes a dc component and an ac component, said method further comprising the steps of:

processing said fourth signal by use of a high pass filter effective to remove said dc component and to generate said output signal.

* * * * *